US007950360B2

(12) United States Patent
Kwak et al.

(10) Patent No.: US 7,950,360 B2
(45) Date of Patent: May 31, 2011

(54) CONTINUOUS VARIABLE VALVE LIFT APPARATUS

(75) Inventors: Young Hong Kwak, Suwon (KR); Kiyoung Kwon, Seoul (KR); Jin Kook Kong, Suwon (KR); Kyoung Joon Chang, Seongnam (KR)

(73) Assignee: Hyundai Motor Company, Seoul (KR)

( * ) Notice: Subject to any disclaimer, the term of this patent is extended or adjusted under 35 U.S.C. 154(b) by 400 days.

(21) Appl. No.: 12/143,093

(22) Filed: Jun. 20, 2008

(65) Prior Publication Data

US 2009/0151664 A1 Jun. 18, 2009

(30) Foreign Application Priority Data

Dec. 14, 2007 (KR) ..... 10-2007-0131575

(51) Int. Cl.
*F01L 1/34* (2006.01)

(52) U.S. Cl. ..... 123/90.16; 123/90.15; 123/90.44

(58) Field of Classification Search ..... 123/90.15, 123/90.16, 90.24, 90.25, 90.39, 90.44
See application file for complete search history.

(56) References Cited

U.S. PATENT DOCUMENTS

| | | | | |
|---|---|---|---|---|
| 6,386,161 | B2 * | 5/2002 | Pierik | 123/90.16 |
| 6,439,177 | B2 * | 8/2002 | Pierik | 123/90.16 |
| 6,644,255 | B1 * | 11/2003 | Henry | 123/90.16 |
| 7,308,874 | B2 * | 12/2007 | Fujita et al. | 123/90.16 |
| 7,640,901 | B2 * | 1/2010 | Aoyama et al. | 123/90.16 |
| 2001/0037781 | A1 * | 11/2001 | Fischer et al. | 123/90.24 |
| 2003/0159667 | A1 * | 8/2003 | Armstrong | 123/90.16 |
| 2006/0243233 | A1 * | 11/2006 | Fujita et al. | 123/90.16 |
| 2009/0031971 | A1 * | 2/2009 | Kwon et al. | 123/90.16 |

* cited by examiner

*Primary Examiner* — Thomas E Denion
*Assistant Examiner* — Daniel A Bernstein
(74) *Attorney, Agent, or Firm* — Morgan, Lewis & Bockius LLP

(57) ABSTRACT

A continuous variable valve lift apparatus according to an exemplary embodiment of the present invention includes an input cam disposed to an input shaft, a first shaft in parallel with the input shaft, a first link connected with the first shaft, a second link rotatably connected to the first link, an output cam that is rotatably connected with the second link and configured with a contact portion contacting the input cam, a second shaft disposed to the output cam parallel with the input shaft, at least one valve unit that is opened and closed by the output cam, and a control part that controls a position of the second shaft.

7 Claims, 7 Drawing Sheets

CONTINUOUS VARIABLE VALVE LIFT APPARATUS

CROSS-REFERENCE TO RELATED APPLICATION

This application claims priority to and the benefit of Korean Patent Application No. 10-2007-0131575 filed in the Korean Intellectual Property Office on Dec. 14, 2007, the entire contents of which are incorporated herein by reference.

BACKGROUND OF THE INVENTION (a) Field of the Invention

The present invention relates to a continuous variable valve lift apparatus. More particularly the present invention relates to a continuous variable valve lift apparatus that can adjust a valve lift amount in response to an operational state of an engine.

(b) Description of the Related Art

A typical combustion chamber of an automotive engine is provided with an intake valve for supplying an air/fuel mixture and an exhaust valve for expelling burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of a gas that is being introduced or exhausted.

If the valve lift apparatus is designed for low driving speeds, the valve open time and amount are not sufficient for high speeds. On the other hand, if the valve lift apparatus is designed for high speeds, the opposite is true.

The above information disclosed in this Background section is only for enhancement of understanding of the background of the invention and therefore it may contain information that does not form the prior art that is already known in this country to a person of ordinary skill in the art.

SUMMARY OF THE INVENTION

Embodiments of the present invention provide a continuous variable valve lift apparatus that may realize various lift operation ranges.

A continuous variable valve lift apparatus according to an exemplary embodiment of the present invention may include an input cam disposed to an input shaft, a first shaft in parallel with the input shaft, a first link connected with the first shaft, a second link rotatably connected to the first link, an output cam that is rotatably connected with the second link and configured with a contact portion contacting the input cam, a second shaft disposed to the output cam and in parallel with the input shaft, at least one valve unit positioned under the output cam, wherein the at least one valve unit is opened and closed by the output cam, and a control part that controls a position of the second shaft.

A supporting portion may support the input cam and the first shaft, and a guiding slot is formed to the supporting portion for the second shaft to be guided.

The control part may include a control unit that is connected with the second shaft and controls a position of the second shaft within the guiding slot.

An input roller may be disposed to the contact portion. A first space may be formed to the output cam for the input cam not to be interrupted when the input cam rotates. A second space may be formed to the second link for the input cam not to be interrupted when the input cam rotates. The valve unit may be a swing arm valve. Further, the valve unit may be a direct drive valve.

According to an exemplary embodiment of the present invention, the continuously variable valve lift apparatus may be constructed with simple elements so that an engine compartment may be designed without difficulty.

The continuously variable valve lift apparatus may be operated without a return spring so that durability may be improved.

When valve lift is lowered, valve timing is advanced.

Elements may be reduced so that productivity may be enhanced and production cost may be reduced. A direct drive valve and a swing arm valve may be applicable, valve lift may be adjusted with a simple design change of an output cam, and a CDA mode may be realized.

Figure 1:
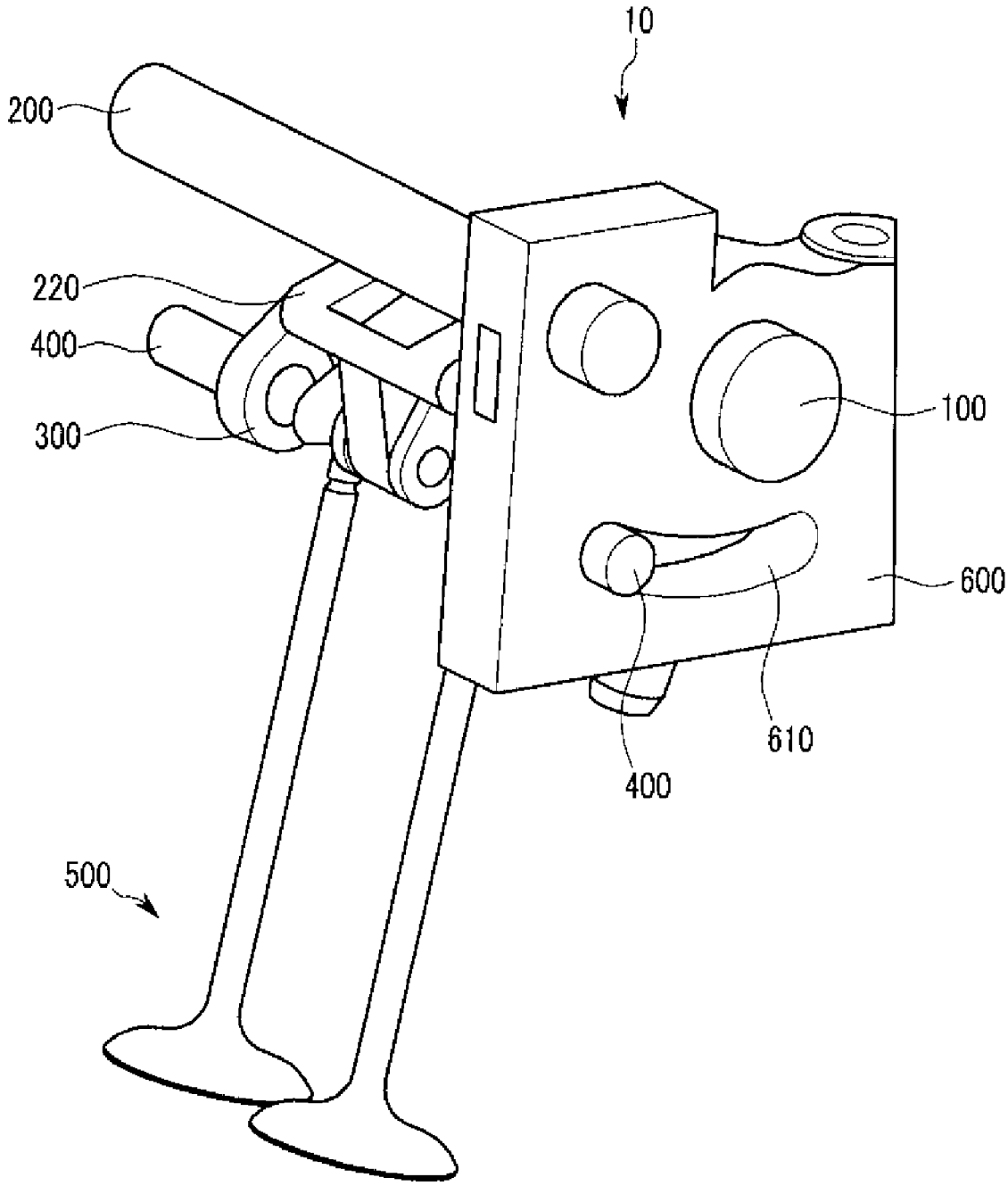
FIG. 1 is a perspective view showing a continuously variable valve lift apparatus according to a first exemplary embodiment of the present invention.

In the figures, reference numbers refer to the same or equivalent parts of the present invention throughout the several figures of the drawing.

REPRESENTATIVE REFERENCE NUMERALS

10, 11: continuously variable valve lift apparatus
100: input shaft
110: input cam
200: first shaft
210: first link
220: second link
300, 301: output cam
310: input roller
400: second shaft
500, 501: valve unit
510: swing arm roller
600: supporting portion
610: guiding slot
700: control unit
810: first space
820: second space

DETAILED DESCRIPTION OF THE EMBODIMENTS

An exemplary embodiment of the present invention will hereinafter be described in detail with reference to the accompanying drawings.

Figure 2:
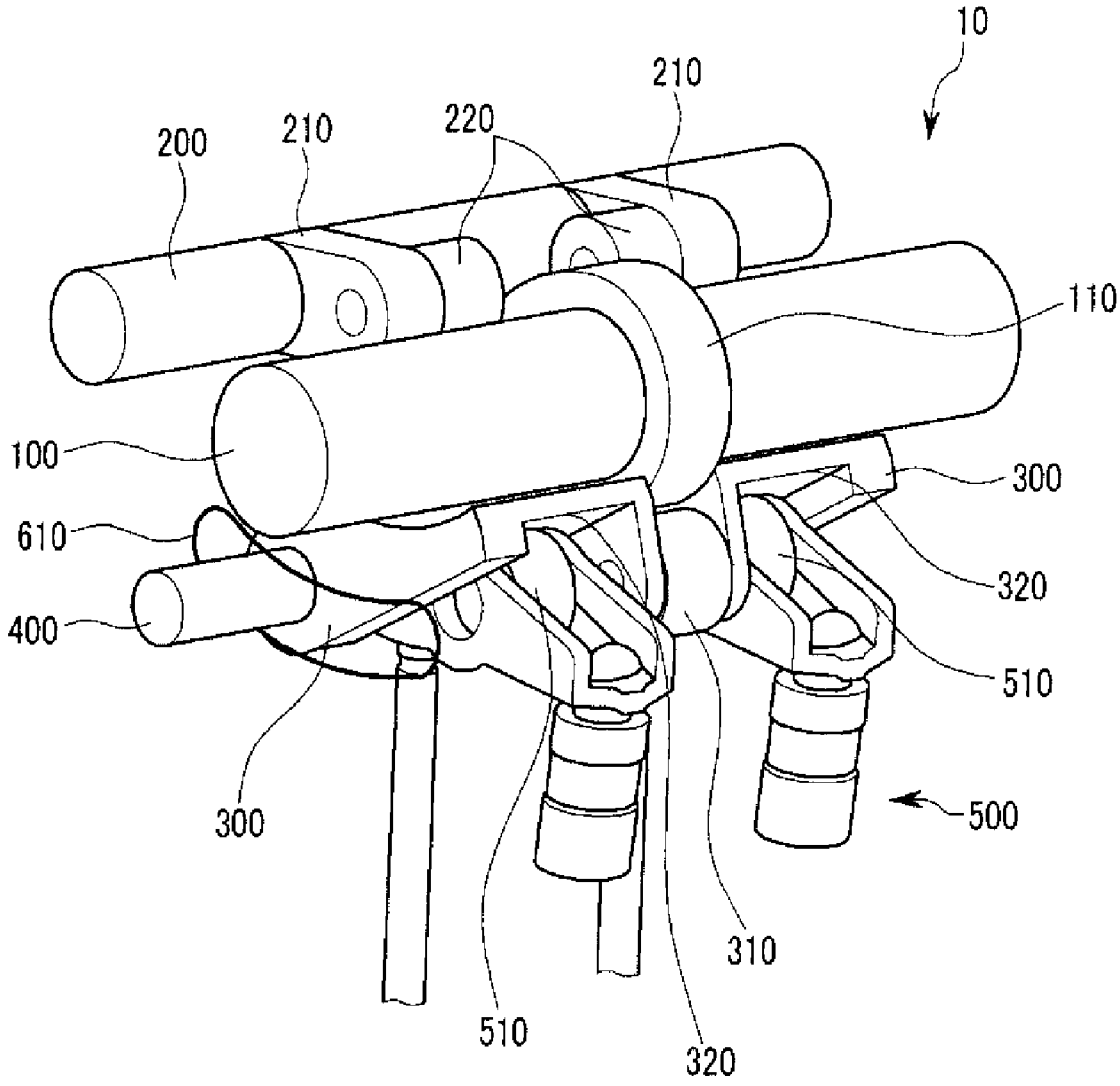
FIG. 2 is aperspective view showing a continuously variable valve lift apparatus according to a first exemplary embodiment of the present invention except a supporting portion.
Figure 3:
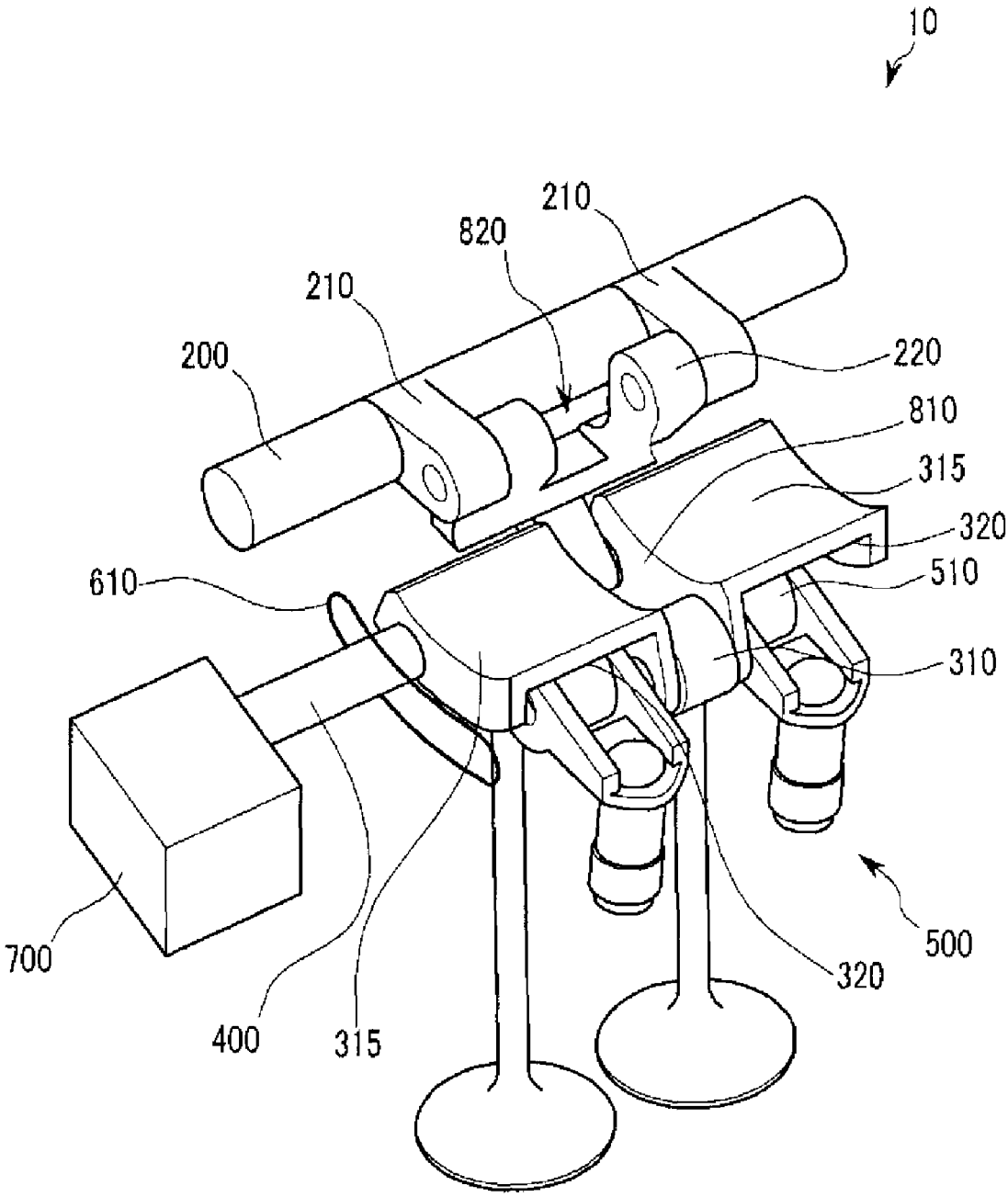
FIG. 3 is a perspective view showing a continuously variable valve lift apparatus according to a first exemplary embodiment of the present invention except an input shaft and an input cam.

Referring to FIG. 1 to FIG. 3, a continuously variable valve lift apparatus 10 according to a first exemplary embodiment of the present invention includes an input cam 110 disposed to an input shaft 100, a first shaft 200 positioned in parallel with the input shaft 100, a first link 210 connected with the first shaft 200, and a second link 220 rotatably coupled to the first link 210.

An output cam 300 is rotatably coupled to the second link 220 and configured with a contact portion contacting the input cam 110.

A second shaft 400 is disposed to the output cam 300 in parallel with the input shaft 100.

At least one valve unit 500 is opened and closed by operation of the output cam 300.

Referring to FIG. 1, the first shaft 200 and the input shaft 100 are supported by a supporting portion 600, and a guiding slot 610 is formed to a portion of the supporting portion 600 for one end portion of the second shaft 400 to be guided along the contour thereof.

Referring to FIG. 1 and FIG. 3, a control part is disposed for controlling a position of the second shaft 400.

The control part includes a control unit 700 that is connected with a distal end portion of the second shaft 400 protruding through the guiding slot 610 and controls an angular position of the second shaft 400 along the guiding slot 610.

An input roller 310 is disposed to the contact portion so that rotation of the input cam 110 is smoothly transmitted to the output cam 300.

A first space 810 is formed to a middle portion of the output cam 300 to receive a portion of the input cam 110 so that the input cam 110 is not interrupted by the output cam 300 when the input cam 110 rotates.

As shown in FIG. 3, the output cam 300 may be formed of two pieces or one piece. When the output cam 300 is formed of two pieces, the first space 810 is formed between the two pieces, and when the output cam 300 is formed of one piece, the first space may be dented within the output cam 300.

A second space 820 is formed to an upper middle portion of the second link 220 and configured to receive a portion of the input cam 110 not to be interrupted by the second link 220 when the input cam 110 rotates. The valve unit 500 is positioned under the output cam 300.

The output cam 300 comprises an upper surface 315 and a contact surface 320. The upper surface 315 of the output cam 300 is positioned under the input shaft 100.

The valve unit 500 may be a swing arm valve configured with a swing arm roller 510 in an exemplary embodiment of the present invention. Accordingly, the contact surface 320 of the output cam 300 slidably contacts the swing arm roller 510.

Hereinafter, referring to FIG. 4 and FIG. 5, an operation of a continuously variable valve lift apparatus according to a first exemplary embodiment of the present invention will be explained.

Figure 4:
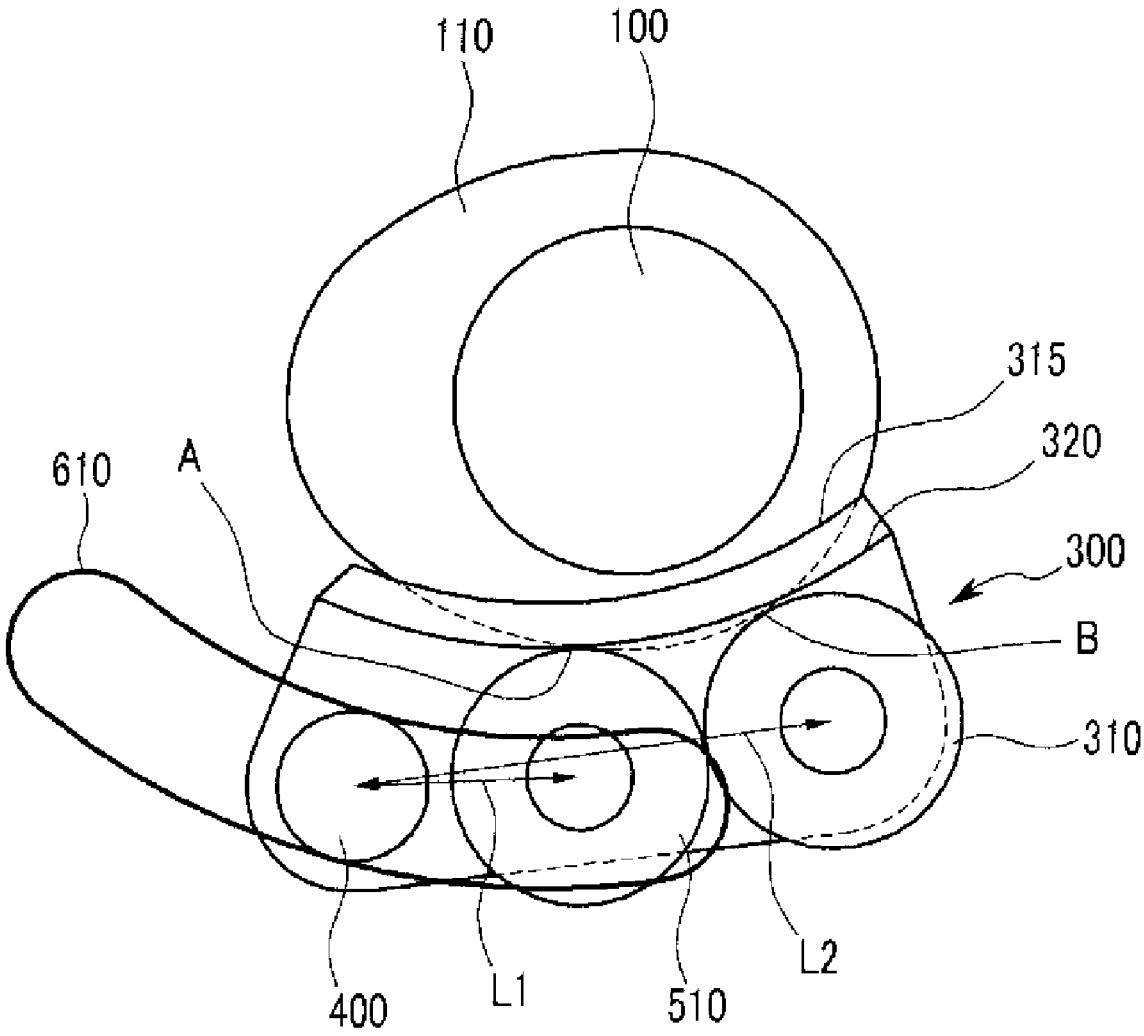
FIG. 4 illustrates an operation of a continuously variable valve lift apparatus according to a first exemplary embodiment of the present invention.

In FIG. 4, the rotation of the input cam 110 is converted to linear movement of the output cam 300 via a contact point B formed between the input cam 110 and the input roller 310 coupled to the output cam 300. Further the linear movement of the output cam 300 is converted to linear movement of the valve unit 500 via a contact point A formed between the contact surface 320 of the output cam 300 and the swing arm roller 510 coupled to the valve unit 500.

Accordingly the distance between the contact points A and B determines the lift length of the valve unit 500.

L1 indicates a distance between a center of the second shaft 400 and a center of the swing arm roller 510, and L2 indicates a distance between the center of the second shaft 400 and a center of the input roller 310. L1 determines a position of the contact point A and L2 determines a position of the contact point B.

Since the second shaft 400 and the input roller 310 are coupled to the output cam 300, the L2 is constant. However, the L1 is variable while a position of the second shaft 400 is changed along the guiding slot 610. That is, a ratio of L1/L2 is changed in accordance with the movement of the second shaft 400 and thus controls the lift length of the swing arm roller 510.

For example, in FIG. 4 as the ratio of L1/L2 is increased, the distance between contact points A and B is decreased and thus the valve lift is increased. In detail, in the drawing, if a position of the second shaft 400 is moved to the left the input roller 310 also moves in the left. Accordingly the valve lift is increased and thus is converted to a high lift mode.

Meanwhile, as the ratio of L1/L2 is decreased, the distance between contact points A and B is increased and the valve lift is decreased accordingly. For example, in the drawing, if a position of the second shaft 400 is moved to the right and the input roller 310 also moves in the right. Accordingly the valve lift is decreased and thus is converted to a low lift mode.

Changing amount of the valve lift depends on the shape of the guiding slot 610 and the shape of the output cam 300. In particular, the shape of the contact surface 320 of the output cam 300 may determine the changing amount of the valve lift. The shape of the guiding slot 610 and the output cam 300 may be selected according to engine size or required performance of an engine.

Figure 5:
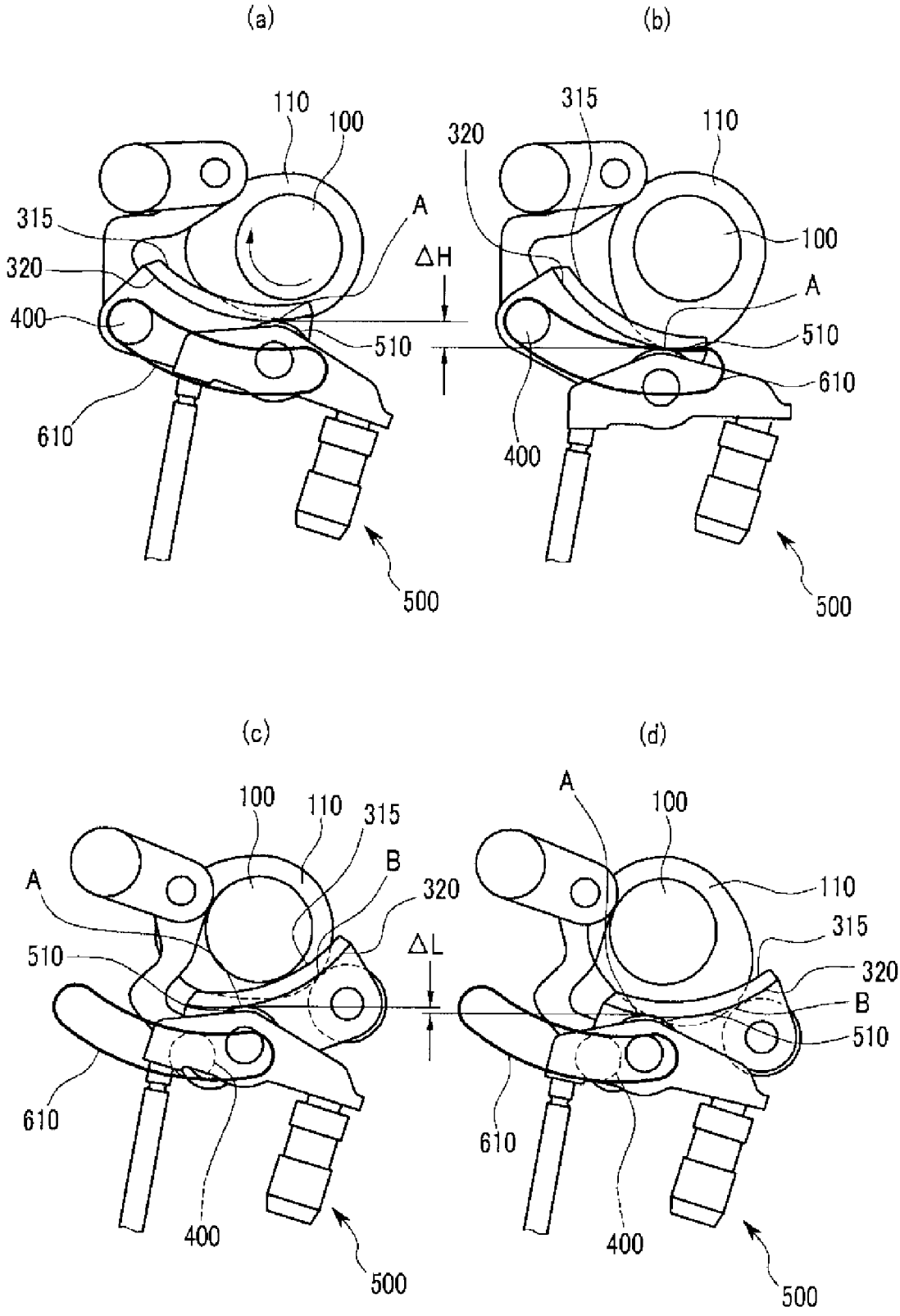
FIGS. 5(*a*) to (*d*) show operations of a continuously variable valve lift apparatus according to a first exemplary embodiment of the present invention according to modes.

FIG. 5(*a*) to (*d*) show operations of a continuously variable valve lift apparatus according to a first exemplary embodiment of the present invention according to modes. In particular, in FIG. 5(*a*) and (*b*), ΔH indicates a valve lift change, i.e., maximum vertical displacement of contact point A in the high lift mode, and ΔL indicates a valve lift change, i.e., maximum vertical displacement of contact point A in the low lift mode in FIG. 5(*c*) and (*d*).

As shown in FIG. 5(*a*) and (*b*), when the control unit 700 moves the output cam 300 in the left, the input roller 310 and the swing arm roller 510 become closer and thus the valve lift is increased as much as ΔH, however, as shown in FIGS. 5(*c*) and (*d*), when the control unit 700 moves the output cam 300 in the right, the input roller 310 and the swing arm roller 510 move away each other and thus the valve lift is reduced as much as ΔL.

Figure 6:
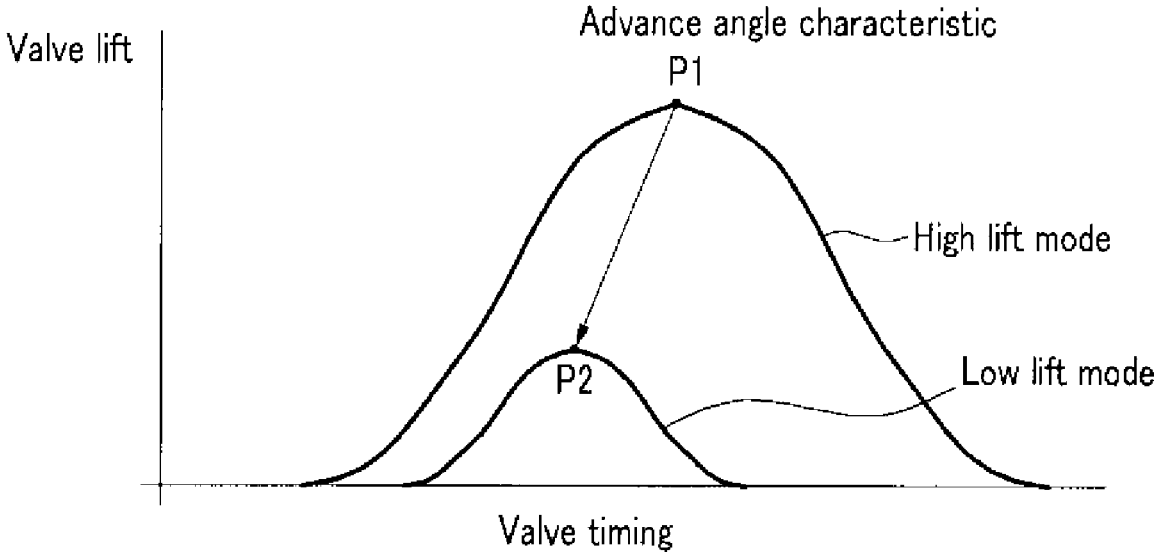
FIG. 6 illustrates an advance angle characteristic of valve timing of the continuous variable valve lift apparatus according to the first exemplary embodiment of the present invention when a valve lift is changed.

FIG. 6 illustrates the advance angle characteristic of valve timing of the continuous variable valve lift apparatus according to the first exemplary embodiment of the present invention when a valve lift is changed. If the valve lift mode is changed from the high lift mode to the low lift mode as shown in FIG. 5, the second shaft 400 rotates in the opposite direction of the rotation direction of the input cam 200, and thus a peak point P2 of the valve profile in low lift mode is more advanced than a peak point P1 in high lift mode.

Figure 7:
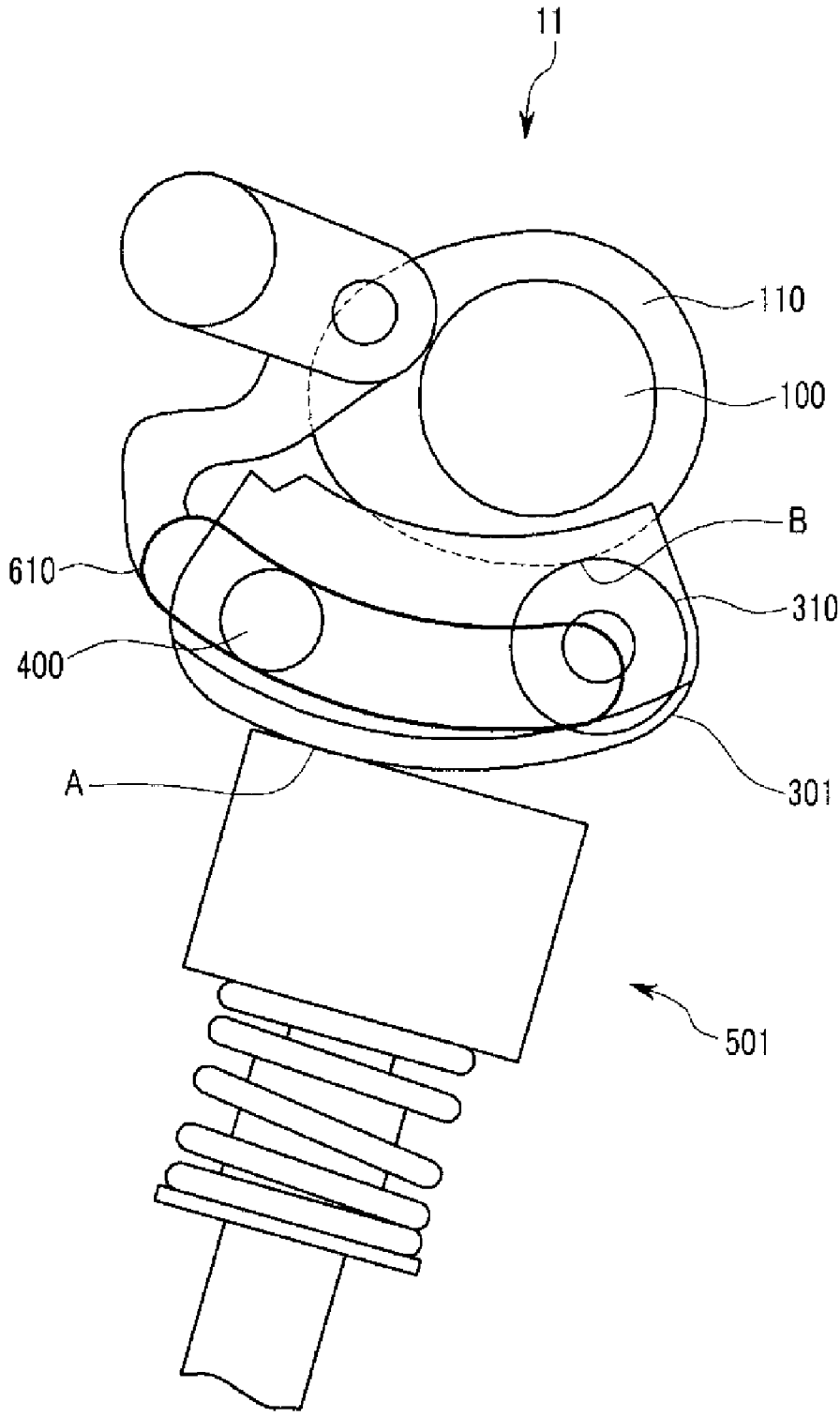
FIG. 7 illustrates a valve unit of a continuously variable valve lift apparatus according to a second exemplary embodiment of the present invention.

FIG. 7 illustrates a valve unit of a continuously variable valve lift apparatus 11 according to a second exemplary embodiment of the present invention. As shown therein, an output cam 301 is shaped as an oval, and a direct drive valve 501 may be used in a continuously variable valve lift apparatus 11.

The second exemplary embodiment of the present invention is otherwise similar to the first exemplary embodiment of the present invention, so a detailed explanation will be omitted.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A continuously variable valve lift apparatus, comprising:

an input cam disposed on an input shaft;

a first shaft in parallel with the input shaft;

a first link connected with the first shaft;

a second link rotatably connected to the first link;

an output cam rotatably connected with the second link and configured with a contact portion contacting the input cam;

a second shaft disposed on the output cam and in parallel with the input shaft;

at least one valve unit positioned under the output cam, wherein the at least one valve unit is opened and closed by the output cam; and a control part that controls a position of the second shaft;

wherein a supporting portion supports the input cam and the first shaft, and a guiding slot is formed to the supporting portion for the second shaft to be guided.

2. The continuously variable valve lift apparatus of claim 1, wherein the control part comprises a control unit that is connected with the second shaft and controls a position of the second shaft within the guiding slot.

3. The continuously variable valve lift apparatus of claim 1, wherein an input roller is disposed to the contact portion.

4. The continuously variable valve lift apparatus of claim 1, wherein a first space is formed to the output cam for the input cam not to be interrupted when the input cam rotates.

5. The continuously variable valve lift apparatus of claim 1, wherein a second space is formed to the second link for the input cam not to be interrupted when the input cam rotates.

6. The continuously variable valve lift apparatus of claim 1, wherein the valve unit is a swing arm valve.

7. The continuously variable valve lift apparatus of claim 1, wherein the valve unit is a direct drive valve.

* * * * *